US008418666B2

(12) United States Patent
Lester et al.

(10) Patent No.: US 8,418,666 B2
(45) Date of Patent: Apr. 16, 2013

(54) MULTIPIECE CAMSHAFT ASSEMBLY

(75) Inventors: Dominique T. Lester, Oxford, MI (US); Rodney E. Baker, Fenton, MI (US); Alan W. Hayman, Romeo, MI (US)

(73) Assignee: GM Global Technology Operations LLC

( * ) Notice: Subject to any disclaimer, the term of this patent is extended or adjusted under 35 U.S.C. 154(b) by 332 days.

(21) Appl. No.: 12/687,178

(22) Filed: Jan. 14, 2010

(65) Prior Publication Data

US 2011/0067654 A1 Mar. 24, 2011

Related U.S. Application Data

(60) Provisional application No. 61/244,237, filed on Sep. 21, 2009.

(51) Int. Cl.
*F01L 1/04* (2006.01)

(52) U.S. Cl.
USPC ..... 123/90.6; 123/90.27; 123/90.44; 29/888.1; 384/248

(58) Field of Classification Search ..... 123/90.6, 123/90.27, 90.44; 29/888.1; 384/248
See application file for complete search history.

(56) References Cited

U.S. PATENT DOCUMENTS 3,014,554 A * 12/1961 Etchells et al. ..... 184/6.9
4,957,079 A * 9/1990 Nakatani et al. ..... 123/90.34
5,826,461 A * 10/1998 Kaywood et al. ..... 74/567
7,074,157 B2 7/2006 Wakashiro et al.
7,975,663 B2 * 7/2011 Davis ..... 123/90.17

FOREIGN PATENT DOCUMENTS

JP 2000120409 A 4/2000

* cited by examiner

*Primary Examiner* — Ching Chang
(74) *Attorney, Agent, or Firm* — Harness, Dickey & Pierce, P.L.C.

(57) ABSTRACT

A camshaft assembly may include a monolithic camshaft body, a journal member and a thrust ring. The monolithic camshaft body may define lobes and journal regions along an axial extent thereof. The journal member may be separate from and fixed to an axial end of the camshaft body adjacent an end lobe of the camshaft body. The thrust ring may be axially secured to the camshaft assembly at the axial end of the camshaft body.

15 Claims, 7 Drawing Sheets

MULTIPIECE CAMSHAFT ASSEMBLY

CROSS-REFERENCE TO RELATED APPLICATIONS

This application claims the benefit of U.S. Provisional Application No. 61/244,237, filed on Sep. 21, 2009. The entire disclosure of the above application is incorporated herein by reference.

FIELD

The present disclosure relates to engine camshafts, and more specifically to multipiece engine camshaft assemblies.

BACKGROUND

This section provides background information related to the present disclosure which is not necessarily prior art.

An engine camshaft assembly may include a thrust ring to axially secure the camshaft relative to an engine structure. The thrust rings are typically formed with the camshaft. The camshaft lobes are typically hardened by a process such as induction hardening. The process generally requires an axial spacing between the thrust ring and the adjacent cam lobe. Therefore, additional length may be added to the camshaft to accommodate the required spacing.

SUMMARY

This section provides a general summary of the disclosure, and is not a comprehensive disclosure of its full scope or all of its features.

A camshaft assembly may include a monolithic camshaft body, a journal member and a thrust ring. The monolithic camshaft body may define lobes and journal regions along an axial extent thereof. The journal member may be separate from and fixed to an axial end of the camshaft body adjacent an end lobe of the camshaft body. The thrust ring may be axially secured to the camshaft assembly at the axial end of the camshaft body. The journal member may be rotationally supported on an engine structure.

A method of assembling a camshaft may include forming a monolithic camshaft body including lobes and journal regions along an axial extent thereof. The camshaft lobes may be induction hardened. A journal member and the thrust ring may be secured to an end of the camshaft body after the induction hardening.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
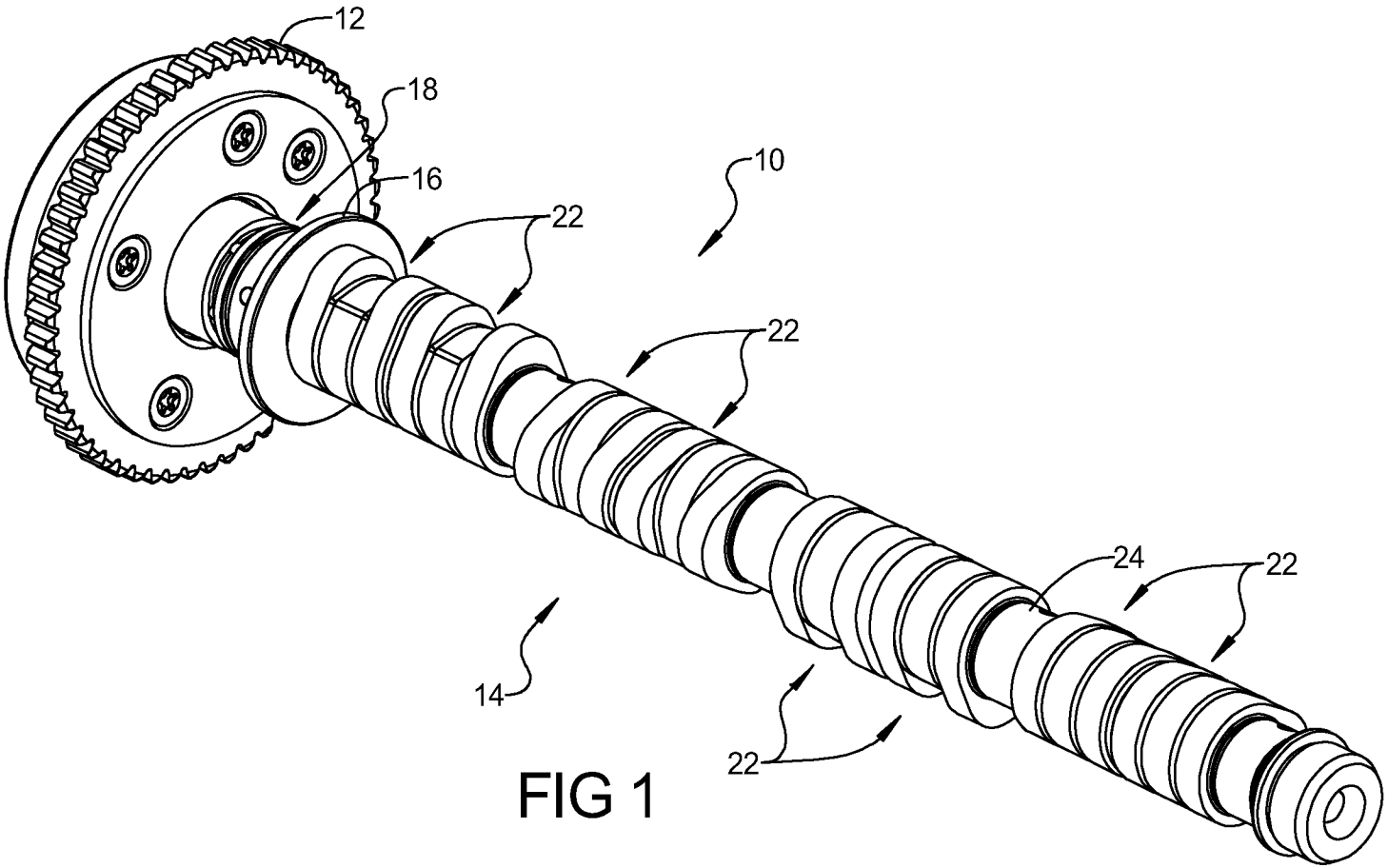
FIG. 1 is a perspective view of a camshaft assembly and a cam phaser according to the present disclosure.
Figure 2:
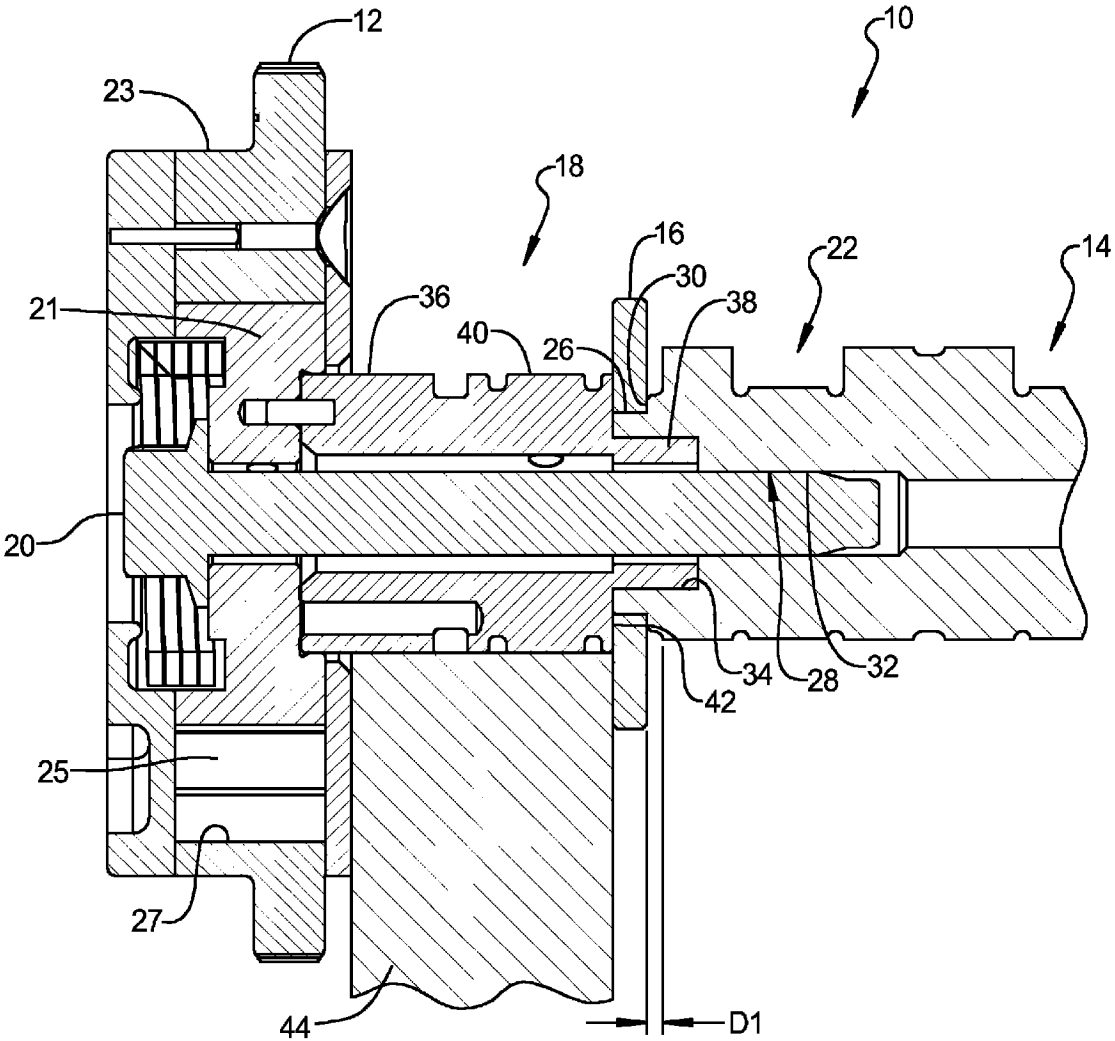
FIG. 2 is a fragmentary section view of the camshaft assembly shown in FIG. 1.

With reference to FIGS. 1 and 2, a camshaft assembly 10 and a cam phaser 12 are illustrated. The camshaft assembly 10 may include a main portion 14, a thrust ring 16 and a front journal member 18. The cam phaser 12 may be coupled to the main portion 14 of the camshaft assembly 10 by a fastener 20. The cam phaser 12 may include any of a variety of cam phaser assemblies.

By way of non-limiting example, the cam phaser 12 may include a hydraulically actuated cam phaser having a rotor 21 and a stator 23. The stator 23 may be rotationally driven by an engine crankshaft. The rotor 21 may be located within the stator 23 and may include radially extending vanes 25 cooperating with the stator 23 to form hydraulic chambers 27 in communication with pressurized fluid, such as oil. The camshaft assembly 10 may be fixed for rotation with the rotor 21 and may be rotated relative to the stator 23 based on the pressurized fluid in the hydraulic chambers 27 acting on the vanes 25. However, while shown in combination with a cam phaser 12, it is understood that the present disclosure is not limited to cam phaser applications and applies equally to camshaft assemblies that do not use cam phasers.

The main portion 14 of the camshaft assembly 10 may define a monolithic camshaft body including lobes 22 integrally formed on a shaft 24. By way of non-limiting example, the monolithic camshaft body may be a cast part. A first end of the main portion 14 may define an outer radial surface 26 and an axial bore 28. The outer radial surface 26 may extend axially between an end lobe 22 and the axial end of the main portion 14. A first axial end surface 30 may be defined between the end lobe 22 and the outer radial surface 26. The axial bore 28 may include first and second portions 32, 34. The first portion 32 may be engaged with the fastener 20 and the second portion 34 may receive the journal member 18, as discussed below.

The thrust ring 16 may be located on the outer radial surface 26 of the main portion 14 and may abut the first axial end surface 30. The camshaft lobes 22 may be induction hardened before the thrust ring is located on the main portion 14. Therefore, the axial distance (D1) between the end lobe 22 and the thrust ring 16 may be less than six millimeters, and more specifically less than three millimeters. The reduced distance between the thrust ring 16 and the end lobe 22 may provide for increased axial width of the lobes 22 without increasing the axial length of the camshaft assembly 10.

The journal member 18 may include first and second regions 36, 38. The first region 36 may define a bearing journal 40 and the second region 38 may couple the journal member 18 to the main portion 14. The second region 38 may be pressed into the second portion 34 of the axial bore 28 and frictionally engaged (i.e., interference fit engagement) with the main portion 14. The first region 36 may have a greater diameter than the second region 38, defining a second axial end surface 42 therebetween. The first and second axial end surfaces 30, 42 may form first and second axial stops. When assembled, the thrust ring 16 may be axially retained between the first and second axial end surfaces 30, 42.

The camshaft assembly 10 may be part of an engine assembly and may be rotationally supported on an engine structure 44. The engine structure 44 may define a bearing rotationally supporting the camshaft assembly 10. FIG. 2 illustrates the journal member 18 rotationally supported on the engine structure 44. The camshaft assembly 10 may be axially secured on the engine structure 44 by the cam phaser 12 and the thrust ring 16. It is understood that the present disclosure applies equally to cam-in-block and overhead camshaft arrangements. The location and assembly of the thrust ring 16 may generally provide for an overall smaller engine length without reducing camshaft lobe width.

Figure 3:
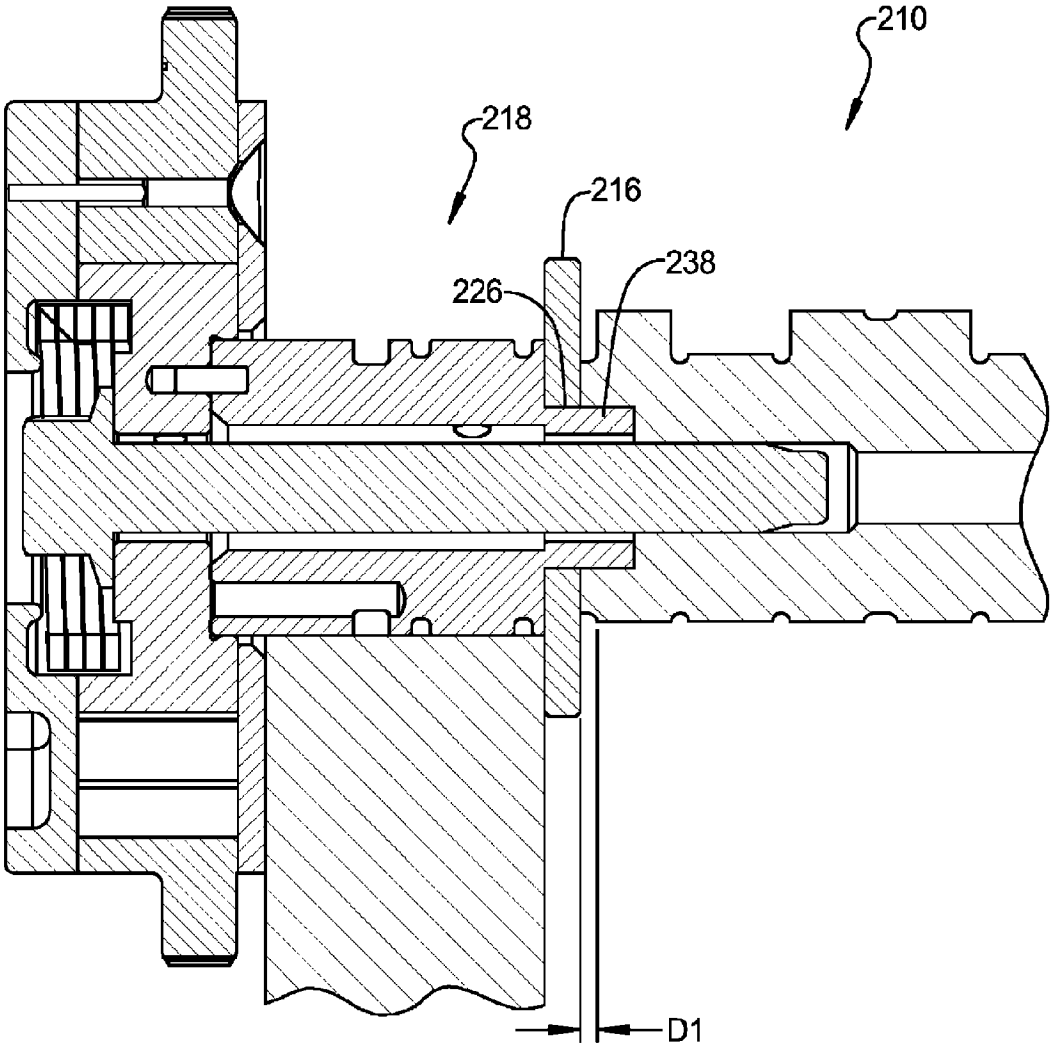
FIG. 3 is a fragmentary section view of an alternate camshaft assembly according to the present disclosure.
Figure 4:
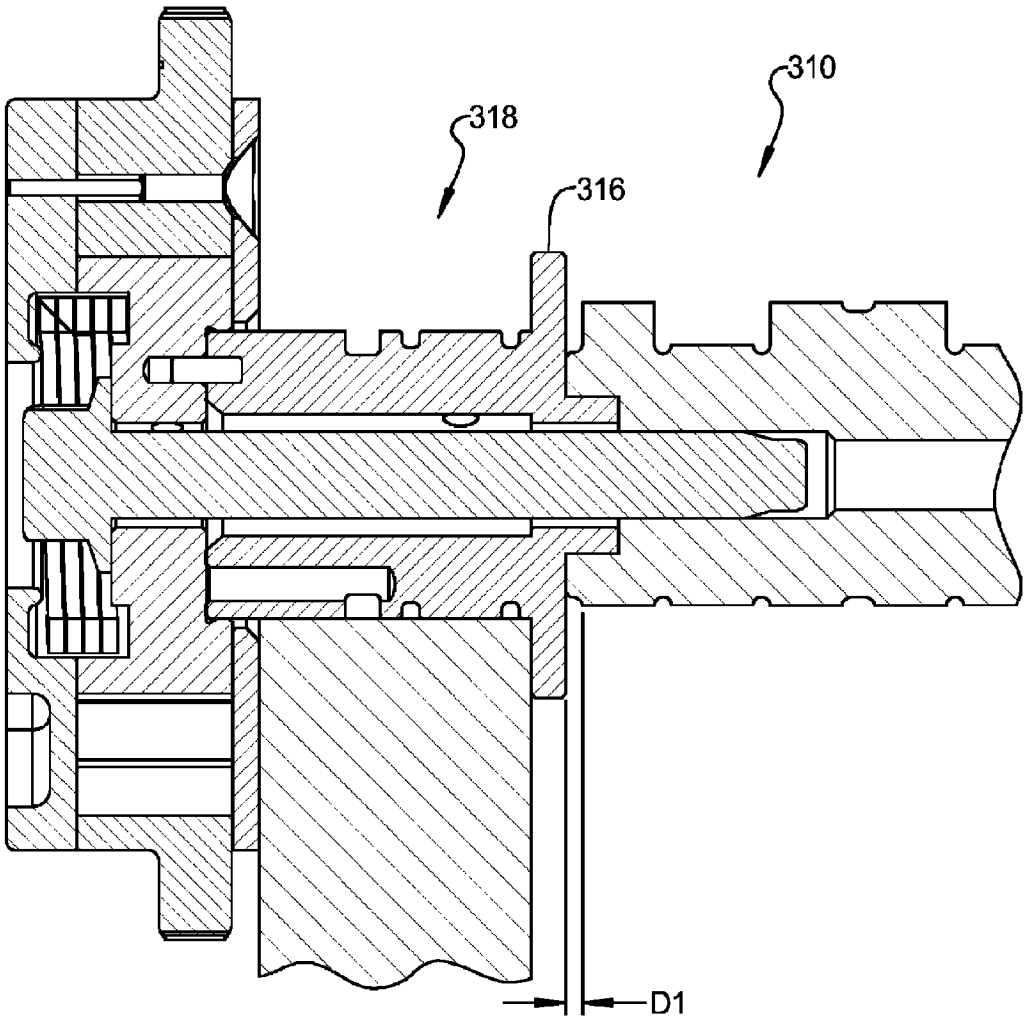
FIG. 4 is a fragmentary section view of an alternate camshaft assembly according to the present disclosure.

In an alternate arrangement seen in FIG. 3, the thrust ring 216 may be located on journal member 218. The camshaft assembly 210 may be generally similar to the camshaft assembly 10. However, the thrust ring 216 may be located on an outer radial surface 226 of the second region 238 of the journal member 218. In another non-limiting example seen in FIG. 4, the thrust ring 316 may be integrally formed with the journal member 318 to create monolithic member.

Figure 5:
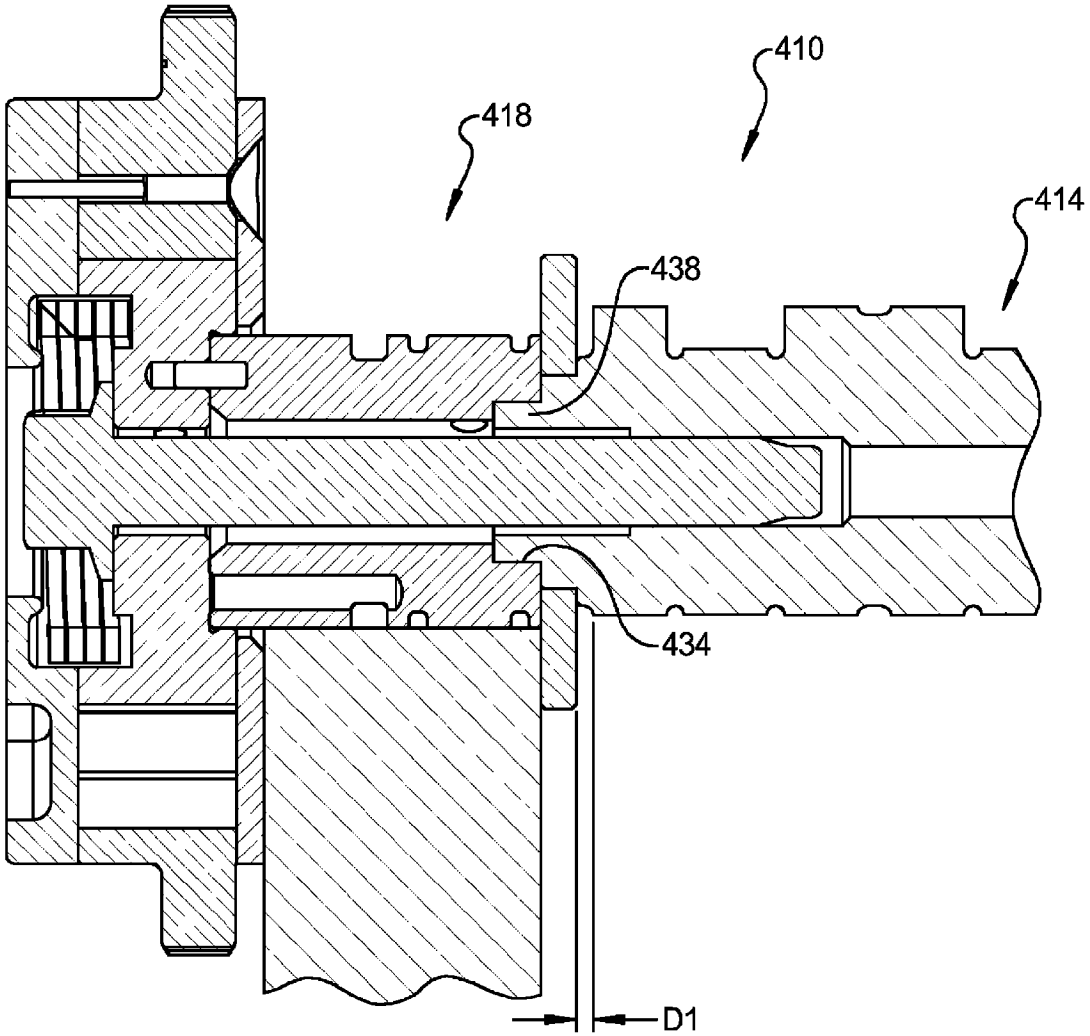
FIG. 5 is a fragmentary section view of an alternate camshaft assembly according to the present disclosure.
Figure 6:
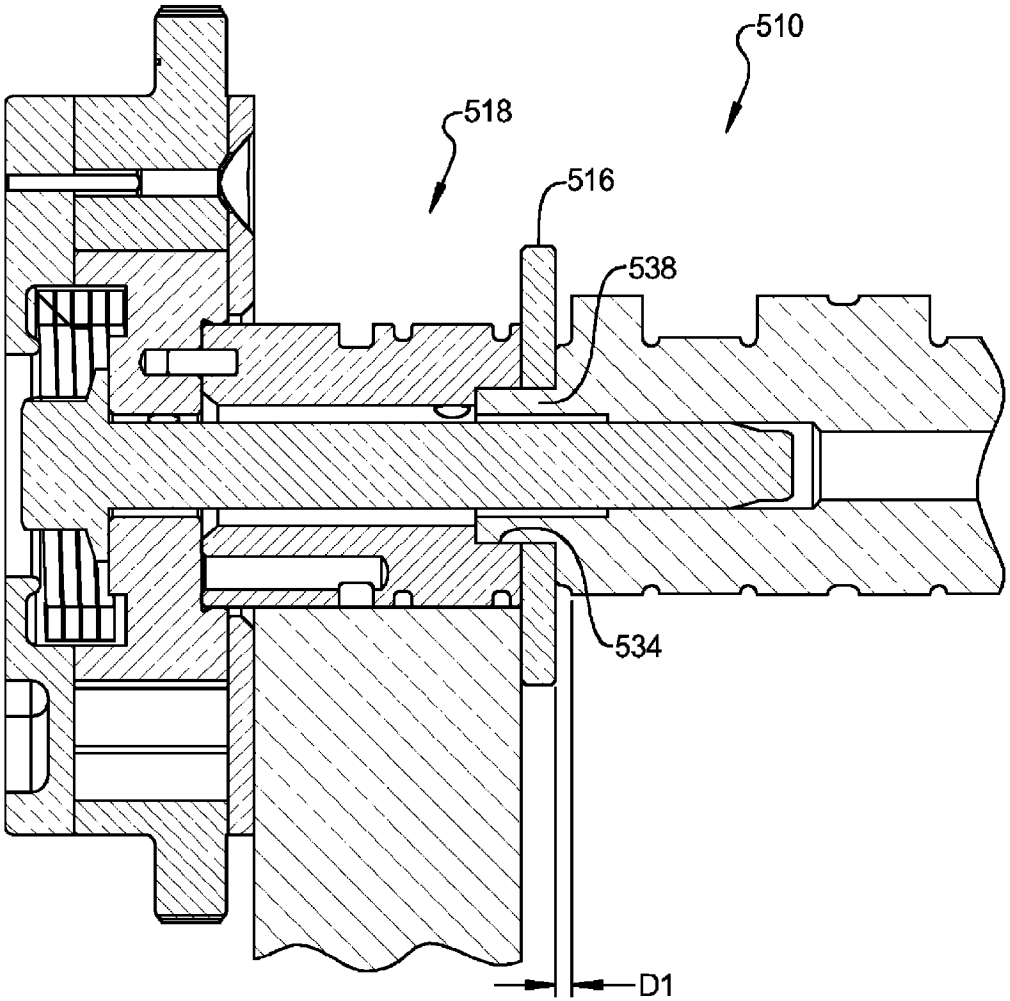
FIG. 6 is a fragmentary section view of an alternate camshaft assembly according to the present disclosure.
Figure 7:
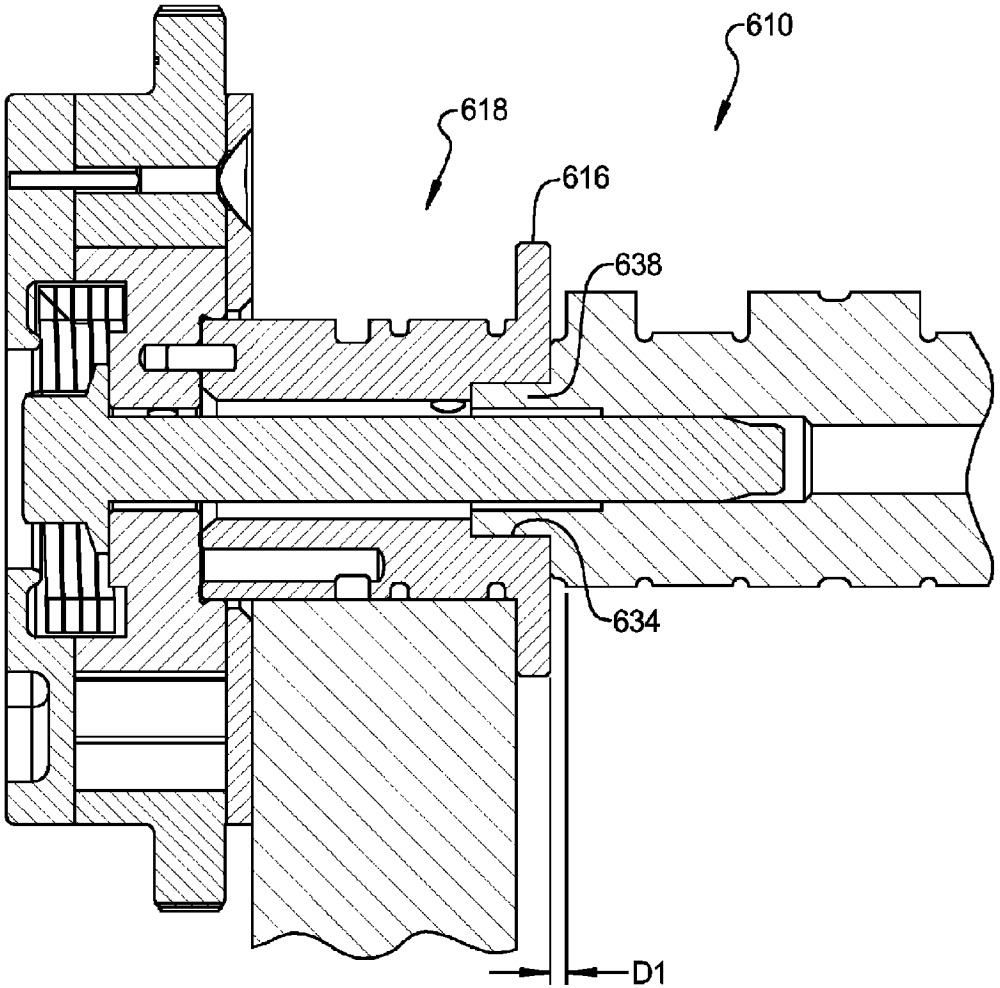
FIG. 7 is a fragmentary section view of an alternate camshaft assembly according to the present disclosure.

In an alternate arrangement seen in FIG. 5, the camshaft assembly 410 may include a main portion 414 of the camshaft body having an axially extending end portion 438 located within an axially extending bore 434 defined by the journal member 418. The end portion 438 may be pressed into the bore 434 and frictionally engaged therewith (i.e., interference fit engagement). In another arrangement seen in FIG. 6, the camshaft assembly 510 may include the end portion 538 of the camshaft body located within the bore 534 of the journal member 518. However, in the arrangement of FIG. 6, the thrust ring 516 may be located on journal member 518. In another arrangement seen in FIG. 7, the camshaft assembly 610 may include the end portion 638 of the camshaft body located within the bore 634 of the journal member 618. However, the thrust ring 616 may be integrally formed with the journal member 618 to create monolithic member.

In any of the camshaft assemblies 10, 210, 310, 410, 510, 610 discussed above, the camshaft lobes may be induction hardened before the thrust ring 16, 216, 316, 416, 516, 616 is coupled to the main portion 14, 214, 314, 414, 514, 614 of the camshaft body. The thrust ring 16, 216, 316, 416, 516, 616 may then be secured to the camshaft assembly 10, 210, 310, 410, 510, 610 in any of the arrangements discussed above. Therefore, the spacing typically required between the end lobe and thrust ring may be avoided to provide a shorter overall engine package.

It is understood that the parts of the camshaft assembly 10 may be coupled to one another in a variety of ways and the present disclosure is not limited to a frictional engagement (i.e., interference fit engagement).

What is claimed is:

1. A camshaft assembly comprising:

a monolithic camshaft body defining lobes and journal regions along an axial extent of the monolithic camshaft body;

a journal member defining an exterior cylindrical surface coaxial with an axis of rotation the monolithic camshaft body and separate from and fixed to an axial end of the monolithic camshaft body adjacent an end lobe of the monolithic camshaft body for rotation with the monolithic camshaft body; and a thrust ring separate from the monolithic camshaft body and axially secured to the camshaft assembly between the monolithic camshaft body and a bearing journal region of the journal member.

2. The camshaft assembly of claim 1, wherein the end lobe is an induction hardened member and is spaced less than 6 millimeters from the thrust ring.

3. A camshaft assembly comprising:

a monolithic camshaft body defining lobes and journal regions along an axial extent of the monolithic camshaft body;

a journal member separate from and fixed to an axial end of the monolithic camshaft body adjacent an end lobe of the monolithic camshaft body; and a thrust ring axially secured to the camshaft assembly at the axial end of the monolithic camshaft body, wherein the monolithic camshaft body includes an axially extending bore defining an inner radial surface and the journal member includes a first portion located axially outward from the monolithic camshaft body and a second portion extending from a first end of the first portion, located within the axially extending bore and defining an outer radial surface engaged with the inner radial surface.

4. The camshaft assembly of claim 3, wherein the thrust ring is axially secured between an axial end surface of the monolithic camshaft body and an axial end surface of the first portion of the journal member.

5. The camshaft assembly of claim 4, wherein the thrust ring includes an inner radial surface located on an outer radial surface of the monolithic camshaft body.

6. The camshaft assembly of claim 4, wherein the thrust ring includes an inner radial surface located on an outer radial surface of the monolithic camshaft body.

7. The camshaft assembly of claim 3, wherein the thrust ring is integrally formed with the journal member, forming a monolithic body.

8. The camshaft assembly of claim 1, wherein the journal member includes an axially extending bore defining an inner radial surface and the monolithic camshaft body includes a first portion extending axially outward from the end lobe, located within the bore and defining an outer radial surface engaged with the inner radial surface.

9. The camshaft assembly of claim 8, wherein the thrust ring is axially secured between an axial end surface of the monolithic camshaft body and an axial end surface of the first portion of the journal member.

10. The camshaft assembly of claim 9, wherein the thrust ring includes an inner radial surface located on an outer radial surface of the monolithic camshaft body.

11. The camshaft assembly of claim 9, wherein the thrust ring includes an inner radial surface located on an outer radial surface of the monolithic camshaft body.

12. The camshaft assembly of claim 8, wherein the thrust ring is integrally formed with the journal member, forming a monolithic body.

13. The camshaft assembly of claim 1, further comprising a cam phaser assembly fixed to the journal member and axially spaced from the thrust ring.

14. An engine assembly comprising:

an engine structure; and a camshaft assembly including:

a monolithic camshaft body defining lobes and journal regions along an axial extent of the monolithic camshaft body;

a journal member defining an exterior cylindrical surface coaxial with an axis of rotation the monolithic camshaft body and separate from and fixed to an axial end of the monolithic camshaft body adjacent an end lobe of the monolithic camshaft body and rotationally supported on the engine structure; and a thrust ring separate from the monolithic camshaft body and axially secured to the camshaft assembly between the axial end of the monolithic camshaft body and a bearing journal region of the journal member, said thrust ring axially securing the camshaft assembly relative to the engine structure.

15. The engine assembly of claim 14, wherein the end lobe is an induction hardened member and is spaced less than 6 millimeters from the thrust ring.

* * * * *